United States Patent [19]

Matheny

[11] Patent Number: 4,757,783

[45] Date of Patent: Jul. 19, 1988

[54] CONTAINER-TO-TAPE DISPENSER FOR DRYWALL JOINT COMPOUND

[76] Inventor: Russell Matheny, 1041 Mount Eaton Rd. South, Dalton, Ohio 44618

[21] Appl. No.: 77,105

[22] Filed: Jul. 23, 1987

[51] Int. Cl.[4] ..... B05C 3/132; B05C 3/18

[52] U.S. Cl. ..... 118/413; 118/415; 118/419

[58] Field of Search ..... 118/415, 405, 419, 429, 118/413

[56] References Cited

U.S. PATENT DOCUMENTS

| | | | |
|---|---|---|---|
| 1,935,060 | 11/1933 | Perkins | 91/43 |
| 2,679,232 | 5/1954 | Brown | 118/413 |
| 2,717,575 | 9/1955 | Merrifield | 118/413 |
| 2,779,307 | 1/1957 | Foresta et al. | 118/413 |
| 3,292,575 | 12/1966 | Letterly | 118/405 |
| 3,342,160 | 9/1967 | Weeks | 118/415 X |
| 3,381,661 | 7/1968 | Brandel | 118/410 |
| 3,496,909 | 2/1970 | Bennett, Jr. | 118/43 |
| 3,513,809 | 5/1970 | Abbott et al. | 118/415 |
| 4,067,294 | 1/1978 | Matechuk | 118/415 |
| 4,159,695 | 7/1979 | Newman | 118/413 |
| 4,367,692 | 1/1983 | Underwood et al. | 118/415 |

*Primary Examiner*—John P. McIntosh

*Attorney, Agent, or Firm*—Michael Sand Co.

[57] ABSTRACT

A container-to-tape dispenser for drywall joint compound intended for use in a point-of-purchase container holding a supply of the compound. The dispenser includes a main body having a generally rectangular elongated base and an inverted generally U-shaped top portion. The main body is removably mounted in and extends between diametrically opposed tape entrance and exit slots formed in the container. A longitudinally extending channel is formed between the base and the top portion. An opening is formed in the top portion to permit a supply of the compound to flow into the channel. The top portion further has a pair of identical spaced side extensions, with a pair of spaced side grooves being formed between the base and said extensions. The grooves function as guides when pulling a length of tape through the dispenser and maintain the edges of the tape relatively dry and free from compound. A tape roll holder is suspended from the container adjacent the tape entrance slot and a length of tape is threaded into the dispenser using a tape threader. A supply of the compound is deposited on the tape as it is pulled through the dispenser, the thickness of compound being controlled by a vertically adjustable metering gate of the dispenser.

17 Claims, 6 Drawing Sheets

CONTAINER-TO-TAPE DISPENSER FOR DRYWALL JOINT COMPOUND

TECHNICAL FIELD

The invention relates to a dispenser for drywall joint compound and in particular to a dispenser adapted to be mounted in a container of the compound. More particularly, the invention relates to a dispenser adapted to be mounted in a container in which the joint compound is packaged and sold, whereby the drywall joint tape is pulled through the dispenser and a predetermined amount of compound is deposited on the tape.

BACKGROUND ART

Drywall tape has been used for many years to cover the joints or seams of abutting wallboards. A typical method for applying the tape to the seams is to press the drywall joint compound into the joint, spread it over the adjacent ends of the wallboards and then place the dry tape over the joint. Another coat of compound is then applied over the tape and, after the compound has dried, it is sanded to a smooth surface suitable for painting. Forcing a sufficient amount of compound into the seams while spreading an evenly distributed, thin coat on the edges of the wallboards has been a problem for the do-it-yourselfer and professional alike.

Application of too much or too little joint compound to the seam area may cause various problems such as bubbles under the tape, edge curling, or may require the drywall installer to spend an inordinate amount of sanding time to achieve the desired smooth surface at the joints of the drywall. Such problems not only increase the time of installation of the drywall but also cause aggravation to the installer as well as, and more importantly, reducing the profit structure of professional drywall installers operating in a competitive pricing environment. These problems also make it more difficult for a drywall installer to comply with minimum standards of the industry in the first phase of joint treatment in drywall installation.

Numerous dispensers have been developed for applying a substance to a strip of material prior to application of the strip to another surface, including drywall joint compound dispensers which apply compound to the tape prior to application of the tape on the seams of wallboards. Examples of these prior art dispensers are shown in U.S. Pat. Nos. 3,496,909; 3,513,809; 3,381,661; 3,292,575; 4,067,294; 1,935,060; 2,717,575; 2,679,232; 2,779,307; 4,159,695.

Although these known prior art dispensers serve their intended purposes, including providing solutions to many of the aforedescribed problems experienced in drywall installation, most of these dispensers require a separate hopper into which the joint compound or other substance must be transferred for dispensing onto the drywall tape or other strip material. Many of these hoppers and/or dispensers are complicated devices which are expensive to manufacture and are time-consuming and expensive to maintain in proper working condition since they include moving parts subject to wear which ultimately require repair or replacement. Furthermore, in others of these prior art devices and/or dispensers, the tape or other strip material cannot be pulled through the dispenser from a position above the exit slot of the hopper because this would cause the joint compound or other substance to be scraped from the tape or other strip material by vertically adjustable metering gates typically found near a tape or strip material exit slot. Also, in most of these dispensers, the full width of the tape or strip material is coated with the compound or other substance, respectively, when the tape or strip material exits the hopper. In many applications, including drywall taping, this is a desirable result because edge curling of the tape or strip material after application to the wallboards or other surface, respectively, is thereby prevented. However, presence of the joint compound or other substance along the edges of the tape or strip material when they are pulled from the exit slot of the hopper makes the tape or strip material more difficult and messy to handle.

A device similar in some respects to my invention is described in U.S. Pat. No. 4,367,692. The device of this patent does not require a separate hopper to dispense the joint compound, and is believed to be the closest known prior art. This patent discloses a dispenser in which drywall tape is coated with joint compound as the tape is pulled through tabbed slots in or associated with a container of the compound. In addition, the tape may be pulled through the container from a position above the exit slot of the dispenser without wiping the coating of compound off the tape. However, a pair of tabs at the exit slot of this device, while allowing pulling of the tape therethrough at any angle between 0° and 75° or even closer to vertical by urging the coated tape away from the top edge of the exit slot, do not prevent the edges of the tape from becoming coated with compound, a result which makes the tape messy and difficult to handle as mentioned above. If the tabs were moved to the outside margins of the exit slot, the edges of the tape would effectively be prevented from becoming coated with compound, but the center of the tape would contact the top edge of the exit slot causing the coating in the middle of the tape to be scrapped away, presumably the precise reason why the tabs are placed inwardly from the outer margin of the exit slot. Thus, although the device of this patent may solve the problem of compound becoming scraped from coated tape when the tape is pulled from the dispenser at an angle above a horizontal plane, it does little to remedy the problem of messy edges on drywall tape which makes application thereof more difficult.

There is no dispenser for applying a drywall joint compound to a strip of tape of which I am aware which utilizes the container in which the drywall joint compound is shipped and stored and that allows the tape to be pulled out of an exit slot subsequently formed in a sidewall of the dispenser at an angle above a horizontal plane without wiping the coating of compound off the tape, and which coats the tape in such a manner that the edges thereof remain relatively dry for ease of handling and application to the drywall.

DISLCOSURE OF THE INVENTION

Objectives of the invention include providing a container-to-tape dispenser for drywall joint compound which aids, with little time of instruction, the do-it yourselfer and the professional in the first phase of joint treatment in a drywall application, which includes the embedding of reinforcing tape in the joints between adjacent wallboards and along inside and outside corners.

A further objective of the invention is to provide a dispenser which may be adjusted to meter a predetermined appropriate amount of compound onto the tape thereby reducing waste of the compound and decreasing time spent replenishing the compound supply, while allowing the drywall installer to comply with standards of the industry in the initial phase of joint treatment in drywall application using less strokes of the embedding knife.

Another objective of the invention is to provide a dispenser in which bubbles or voids under the tape, edge curling of the tape, sanding, and "skinning over" in rapid drying conditions are minimized as a result of the metering of the correct amount of compound onto the tape while keeping the edges thereof relatively dry as the tape is pulled from the dispenser for ease of handling.

A still further objective of the invention is to provide a dispenser which will speed the application of drywall tape to wallboard seams thus enhancing the profit structure for professionals in a competitive pricing environment by dispensing the compound on the tape prior to application of the tape on the seams and by shortening start-up time and clean-up time in day-to-day and job-to-job applications.

Still another objective of the invention is to provide a dispenser which may be installed in any container containing the compound, preferably the original shipping container of the joint compound.

Another objective of the invention is to provide a dispenser having a low-cost simple design, which is relatively small in size and lightweight for ease of storage and transportation, and which requires little or no maintenance since there are no moving parts to repair or replace thus significantly reducing the possibility of costly downtime on the job.

A further objective of the invention is to provide a dispenser in which the drywall installer will have both hands available to manipulate the tape and taping knife when applying the tape to wallboard seams, and in which the tape may be pulled through the exit slot of the container in which the dispenser is placed from a location above the exit slot without scraping the dispensed compound off the tape.

Still another objective of the invention is to provide a dispenser which is constructed of a material that will withstand prolonged exposure to joint compound and moisture without being adversely effected; and which is safe to use because there is no heavy equipment to manipulate and both hands of the drywall installer are free permitting normal body movement during installation thereby reducing fatigue.

A further objective of the invention is to provide a dispenser which is easily threaded even after being mounted in a container holding a supply of the compound and which will accept either 2" or 2 1/16" tape.

Another objective of the invention is to provide a dispenser which may be utilized to dispense other substances on strips of material other than drywall tape with many or all of the aforementioned advantages and benefits.

These objectives and advantages of the invention are obtained by the container-to-tape dispenser for drywall joint compound, the general nature of which may be stated as including, in combination, a container for containing a supply of joint compound having a bottom wall and a sidewall extending upwardly therefrom, said sidewall being formed with diametrically opposed tape entrance and exit slots formed adjacent said bottom wall; means for supporting a roll of tape adjacent the tape entrance slot; and a dispenser including a main body having an elongated base and an inverted generally U-shaped top portion extending through the entrance and exit slots, said top portion forming a longitudinally extending channel and a pair of spaced side grooves between the base and the top portion, said top portion having an opening formed therein for supplying compound into the channel; a pair of vertically adjustable metering gates movably mounted within a pair of transverse slots formed in the top portion of the main body adjacent outer ends thereof and located exteriorly of the container for varying the thickness of joint compound deposited from the container on the tape as the tape is pulled through the channel and side grooves and out of the exit slot.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

The improved dispenser of the invention which is adapted to be mounted in a usual container containing drywall joint compound is indicated generally at 10, and is shown in detail in FIGS. 2–7. The dispenser is shown in FIG. 1 mounted on a usual point-of-purchase container, indicated generally at 12.

Container 12 is of a usual construction preferably having a circular bottom wall 14 and a cylindrical sidewall 16 formed integrally therewith. Although dispenser 10 is adaptable for use with containers of various configurations, in its preferred embodiment the dispenser is mounted in a container having the aforedescribed configuration, which is essentially that of a usual shipping container for joint compound of the type used in drywall applications.

Figure 1:
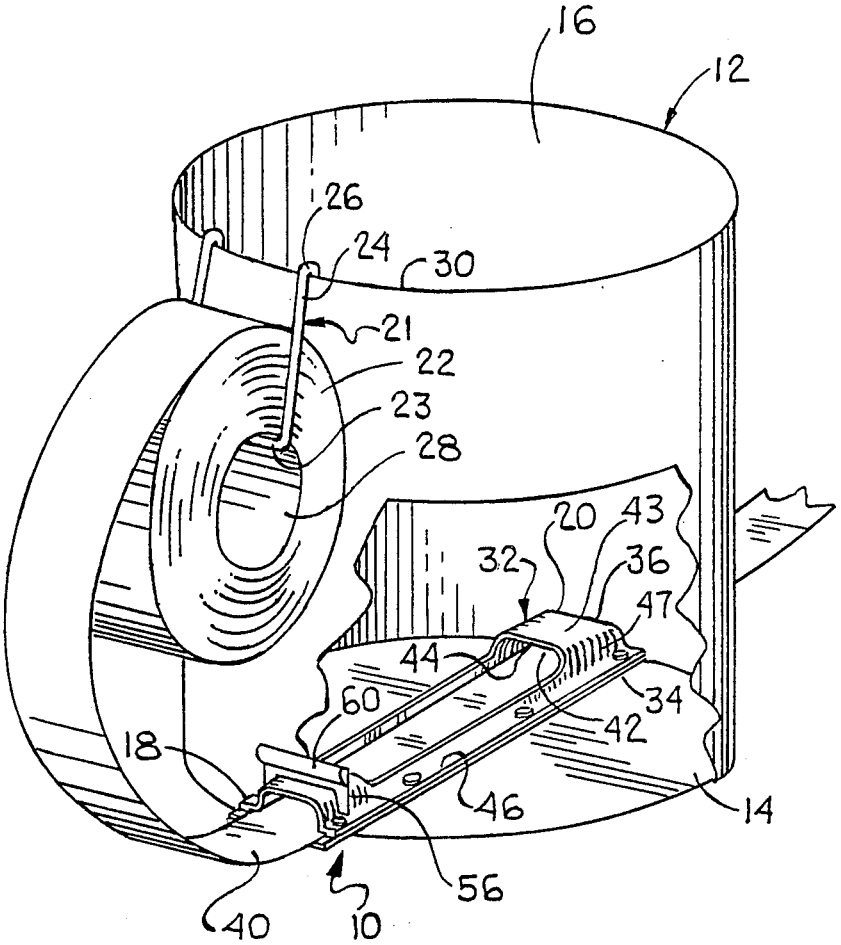
FIG. 1 is a perspective view of the dispenser mounted in a container with a portion of the container broken away, and showing the tape roll holder mounted on the container and supporting a roll of tape, with a length of the tape passing through the dispenser.
Figure 2:
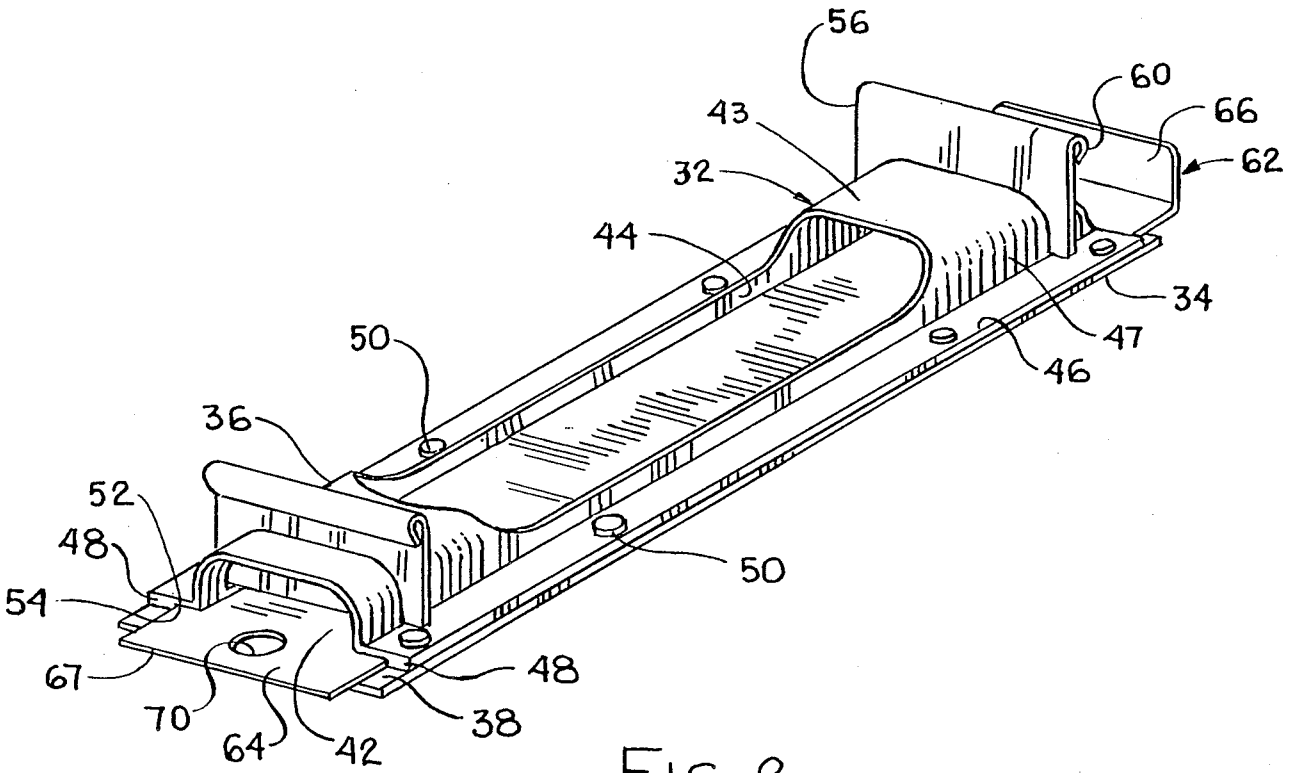
FIG. 2 is a perspective view of the dispenser showing the tape threader inserted therein.

Dispenser 10 is removably mounted in diametrically opposed tape entrance and exit slots 18 and 20, respectively, formed in sidewall 16 of container 12 adjacent bottom wall 14 (FIG. 1). The entrance and exit slots are identical in configuration and may be formed in sidewall 16 by using pressure sensitive templates (not shown), which are attached to sidewall 16, to outline the pattern of the slots. An appropriate cutting tool then is used to cut the slots in the sidewall.

Figure 10:
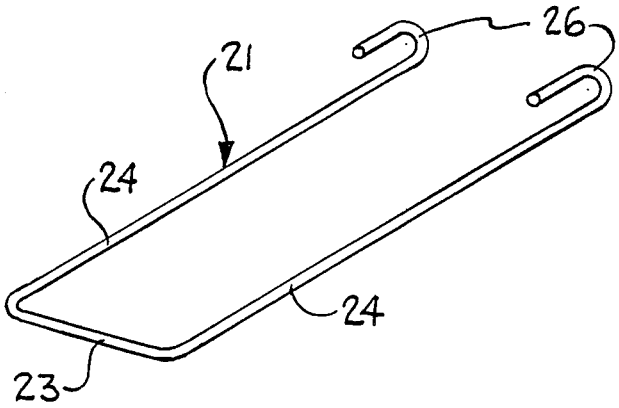
FIG. 10 is a perspective view of the tape roll holder of FIG. 1.

A tape holder, for dispensing a usual roll of drywall tape 22, is indicated generally at 21 (FIG. 10) and is shown mounted on container 12 in FIG. 1. Holder 21 includes a transverse rod 23 which is integral with and extends between a pair of identical spaced parallel rods 24. Unconnected ends of rods 24 are bent back upon themselves to form U-shaped hangers 26. A hub 28 of tape roll 22 is removably mounted on transverse rod 23, and hangers 26 engage a top edge 30 of sidewall 16 whereby tape roll 22 is suspended from container 12 above tape entrance slot 18. The tape holder preferably is formed of 11 ½ gauge galvanized wire which may be bent and shaped to position the tape roll relative to the container as desired by the user thereof.

Figure 11:
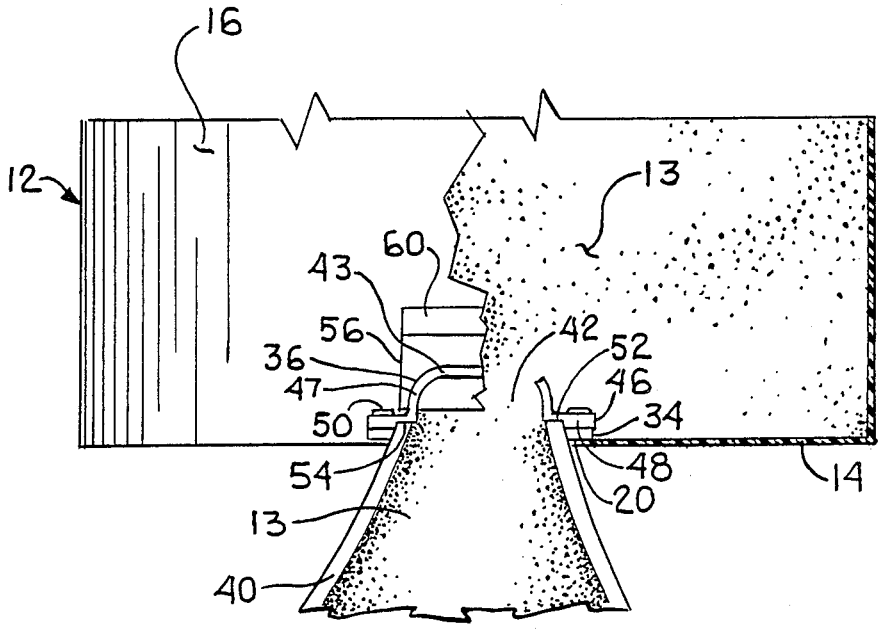
FIG. 11 is a view of the container exit slot of FIG. 1 with portions broken away and in section, particularly showing the amount of joint compound deposited on the tape as it is pulled through the dispenser.

Dispenser 10 includes a main body, indicated generally at 32 (FIG. 3), which includes an elongated generally rectangular base 34 and a generally inverted U-shaped top portion 36. Base 34 is preferably formed of 3 ounce mat fiberglass and its upper surface 38 has a mar-resistant, smooth, laminated plastic surface finish of the type generally sold under the trademark Formica to assist in the slidable movement of a length of tape 40 (FIGS. 1 and 11) through dispenser 10, as will be described in more detail below.

Figure 3:
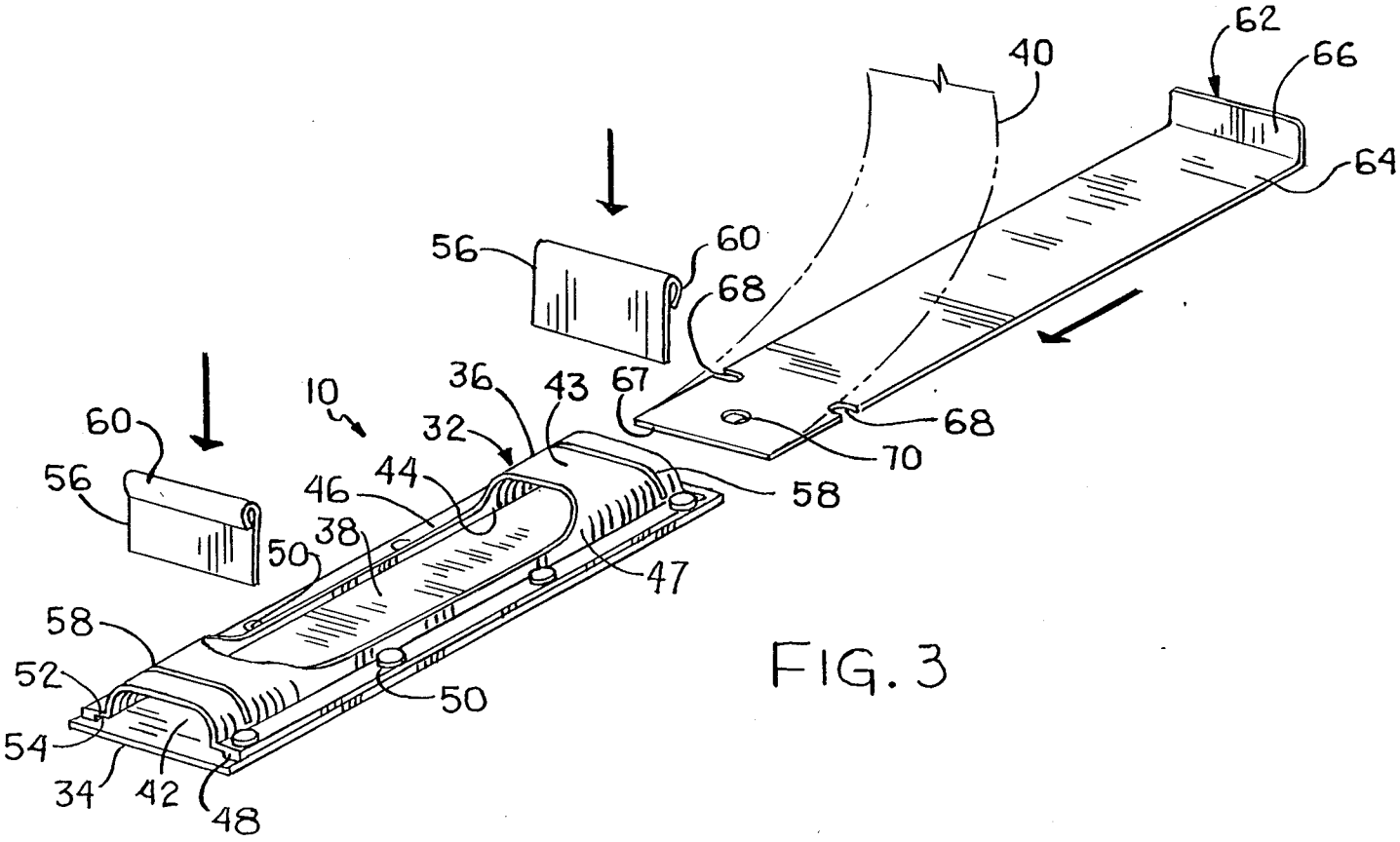
FIG. 3 is an exploded perspective view of the dispenser of FIG. 2 showing in dot-dash lines a length of tape folded about the tape threader and a pair of metering gates disengaged from the main body of the dispenser.
Figure 4:
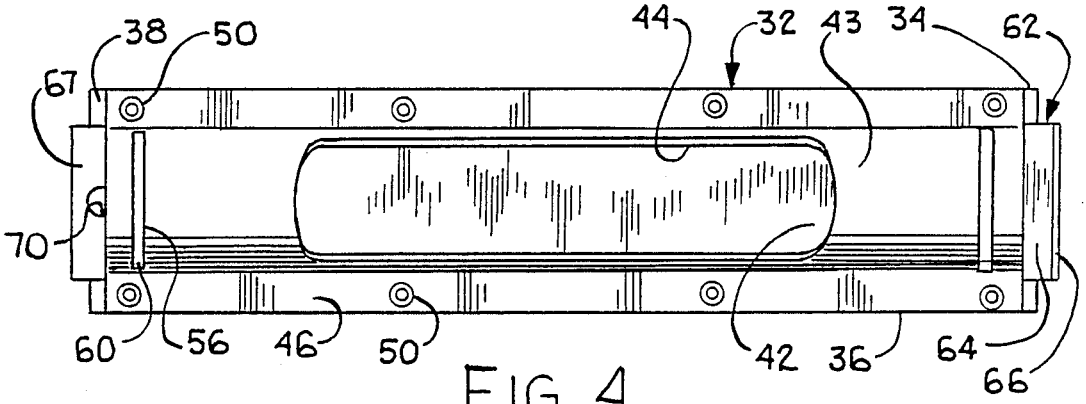
FIG. 4 is a top plan view of the dispenser and tape threader of FIG. 2.
Figure 5:
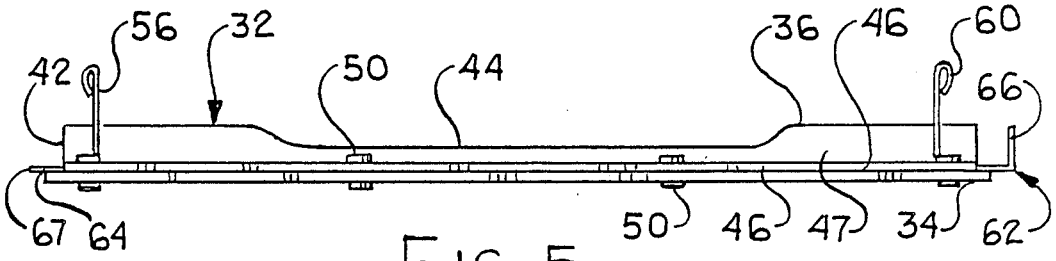
FIG. 5 is a side elevational view of the dispenser and tape threader of FIG. 4.
Figure 6:
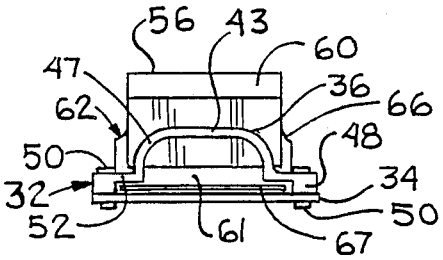
FIG. 6 is a left-hand end view of the dispenser and tape threader of FIG. 5.
Figure 7:
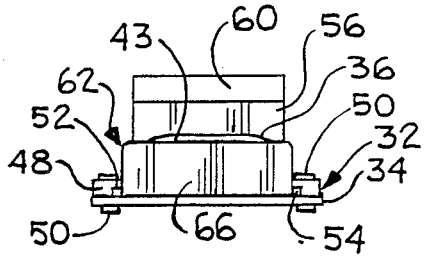
FIG. 7 is a right-hand end view of the dispenser and tape threader of FIG. 5.

Top portion 36, which preferably is formed of 3 ounce mat fiberglass, is attached to base 34 by a plurality of rivets 50. Top portion 36 may be formed integrally with base 34 without effecting the concept of the invention. Top portion 36 and base 34, which form main body 32, provide a longitudinally extending channel 42 therebetween (FIG. 3). Top portion 36 has a top wall 43 which is formed with a generally oval-shaped opening 44 which extends a substantial distance transversely and longitudinally along the wall. Opening 44 (FIG. 1) allows joint compound 13 (FIG. 11) in container 12 to flow into channel 42 and provide a steady supply of the compound to be dispensed on tape 40 as it is pulled through dispenser 10.

Top portion 36 has a pair of identical spaced side extensions 46 (FIGS. 2 and 6) formed integral with and extending transversely from curved sidewalls 47 which extend downwardly from top wall 43. Extensions 46 extend along the entire length of top portion 36 and are attached to base 34 by rivets 50.

Figure 12:
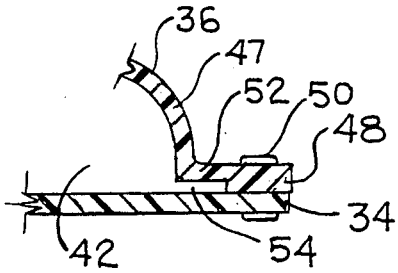
FIG. 12 is a greatly enlarged fragmentary end view of a side groove of the dispenser of FIG. 3.

Each extension 46 is formed with an internal stepped area 48 adjacent upper surface 38 of base 34 (FIGS. 3 and 12). These stepped areas provide support and an area for attachment of top portion 36 to the base. Rivets 50 pass through stepped areas 48 of each extension 46 and through base 34 to secure the top portion to the base. Another stepped area 52 is formed on extensions 46 and extends approximtely half the height of outer stepped areas 48. Stepped areas 52 form longitudinally extending grooves 54 between upper surface 38 of base 34 and extensions 46. The function of grooves 54 will become apparent as the operation of dispenser 10 is described in full detail below.

Dispenser 10 further includes a pair of vertically adjustable metering gates 56 (FIG. 3) which are movably mounted in transverse slits 58 formed in top portion 36 of main body 32 adjacent the ends thereof. Each gate 56 is generally rectangular in shape and has a top edge which is bent back upon itself to form a flange 60 which provides for easy grasping of the gates by the drywall installer. The gates preferably are made of 24 gauge galvanized sheet metal and are movably mounted in the slits exteriorly of and adjacent sidewall 16 of container 12 at entrance and exit slots 18 and 20, respectively. The gate adjacent exit slot 20 regulates the amount of joint compound 13 deposited from container 12 onto tape 40 as the tape is pulled through channel 42 and grooves 54 and out of the exit slot. The gate located adjacent entrance slot 18, as shown particularly in FIG. 1, merely functions to prevent the flow of the compound out of the dispenser at the entrance slot and to maintain the dispenser in position with respect to container sidewall 16.

Each slit 58 extends transversely across top wall 43 of top portion 36 and along sidewalls 47, terminating adjacent the side extensions 46. Each gate 56 has a transverse width which exceeds the transverse width of slits 58. Extensions 46 thus act as a stop to the continued downward movement of the gate in the slits. When the gates are moved to their downwardmost position in slits 58, channel 42 is reduced in the plane of each gate to a generally rectangular opening 61 defined by the upper surface of tape 40, the bottom edge of gate 56, and the inside surface of the top portion as shown particularly in FIG. 6. Opening 61 adjacent exit slot 20 allows an amount of joint compound 13 corresponding to the dimensions of the opening to remain on the tape as it is pulled out of dispenser 10. The compound does not flow out of opening 61 adjacent entrance slot 18 since the compound is very viscous and the movement of the tape through the dispenser urges the flow of compound toward the exit slot. The predetermined amount of compound coresponding to opening 61 is appropriate for most drywall applications, but if the drywall installer desires a larger amount of the compound to be deposited on the tape, the gate adjacent the exit slot may be vertically adjusted pursuant thereto.

Figure 8:
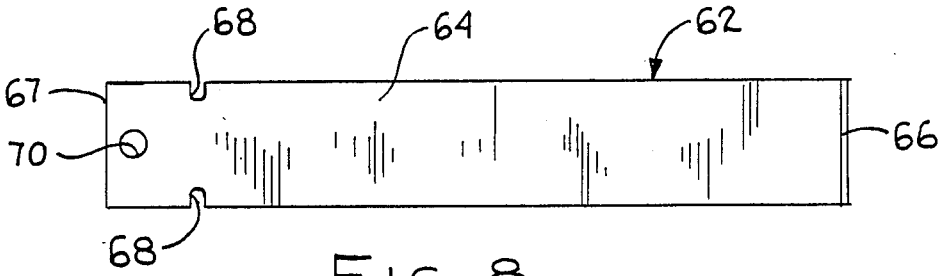
FIG. 8 is a top plan view of the tape threader of FIG. 3.
Figure 9:
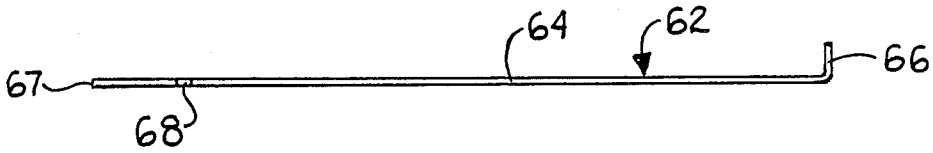
FIG. 9 is a side view of the tape threader of FIG. 8.

A tape threader, indicated generally at 62 (FIGS. 3, 8 and 9), includes an elongated, generally rectangular base 64 having a length which exceeds that of base 34 of main body 32 (FIGS. 2, 4 and 5) and a width which is generally equal to the width of tape 40. The threader has a vertical flange 66 at one end thereof which is integral with and perpendicular to base 64 to provide for manual manipulation of the tape threader and for storage purposes as will be described more fully below. The front end 67 of threader base 64 is adapted to receive a length of tape 40 which is folded over the base as shown by dot-dash lines in FIG. 3. The threader, including the folded tape end, is inserted into grooves 54 in the direction of the arrow in FIG. 3 and pushed through channel 42 thereby allowing the tape to be grasped at exit slot 20 when dispenser 10 is mounted in container 12. Threader 62 then is slidably removed from dispenser 10. The threader also functions to remove any joint compound 13 which may be present in grooves 54 after completion of a job or before the start of another job. As threader 62 is pushed through the dispenser a slot 68 (FIGS. 3, 8 and 9), formed in each longitudinal edge of threader base 64 adjacent front end 67, collects and displaces any excess joint compound 13 in the grooves.

An opening 70 in the threader base (FIGS. 2, 3 and 8) adjacent front end 67 assists in the storage of dispenser 10. The threader is inserted into the dispenser and is suspended from a nail (not shown) or the like by opening 70, with flange 66 functioning as a stop to prevent the dispenser from sliding off of the threader because of gravitational forces thereby effectively suspending the dispenser from the nail.

Before commencement of the drywall taping operation, the installer can utilize the pressure sensitive templates (not shown) to outline the pattern for the entrance and exit slot openings 18 and 20, respectively, in the sidewall of the joint compound container. In accordance with one of the main advantages of the invention, the usual container in which the joint compound is shipped and sold is used with the dispenser, although the dispenser may be used in conjunction with other containers if desired. The container, if already filled with the joint compound, then is inverted to displace the compound away from the bottom wall of the container so that the compound will not flow out of the openings being cut into the sidewall. The openings are cut out using a usual cutting tool such as a utility knife or the like, and using the template as a guide. The main body of the dispenser is inserted through the openings so that both transverse slits 58 are located adjacent and exteriorly of sidewall 16. The container then is placed in its upright position and the metering gates are inserted in the slits 58.

The hub 28 of the tape roll is inserted about the transverse rod 23 of the tape holder and the holder is suspended by its hangers from the top edge of the container. The holder may then be bent and shaped, if necessary, so that the tape roll moves freely about the transverse rod without interference from the sidewall of the container. A length of the tape is pulled from the roll and folded over the front end 67 of the tape threader, the threader and tape then being grasped by flange 66 and pushed through the grooves 54 and channel 42 of the dispenser. After threading, the front end of the threader extends beyond the transverse front end (FIGS. 2, 4 and 5) of the base of the dispenser, whereby the tape is manually removed from the threader and the threader is retracted from the dispenser leaving the tape therein. The tape then is pulled through the channel 42 of the dispenser, guided by the grooves 54, for application to the drywall.

As described above, as the tape is pulled through the dispenser, the joint compound flows through opening 44 and onto the tape. The gate adjacent the exit slot 20 functions to meter the amount of compound that remains on the tape as it is pulled from the dispenser. Furthermore, the edges of the tape remain relatively dry and free from compound (FIG. 11), a desirable feature in drywall applications as mentioned above, because the grooves 54 function to shield the edges of the tape from the flow of the compound. Also, the tape may be pulled from the dispenser by an installer working at a position above the exit slot 20 without appreciably effecting the amount of joint compound deposited on the tape. This feature is accomplished by the grooves 54 which act as a stop whereby the upper surface of the tape is prevented from contacting the bottom edge of the exit slot gate thereby preventing the compound from being scraped from the tape by the gate. More specificially, the edges of the tape, when the tape is pulled through the dispenser from a position above the exit slot 20, are prevented from moving upward by inside step 52 of extension 46, thereby effectively preventing the center portion of the tape from moving upward toward the bottom edge of the gate. After a desired length of tape has been coated with the compound, the tape may be cut and applied to the joints of the wallboards. The above procedure considerably shortens the time required to install drywall and the tape thereby enhancing the profit structure for the professional drywaller working in a competitive pricing environment.

At the completion of a day on the job, the ends of the dispenser preferably are covered with a wet cloth or the like which assists in preventing any compound remaining in the ends of the dispenser from drying out. Before beginning work the next day, excess compound is displaced from the grooves using the tape threader. At the completion of a job, the dispenser may be removed from the container if the container is empty, cleaned and stored, and is ready for use on the next job. Alternatively, the dispenser may be left in the empty container for use on the next job, at which time joint compound or another substance may be transferred into the empty container from the shipping container of joint compound or other desired substance. If compound remains in the container at the end of a job, the container and dispenser still may be stored as if for use on the next job.

Accordingly, the improved dispenser for drywall joint compound is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly contsrued.

Moreover, the description and illustration of the invention is by way of example, and the scope of the invention is not limited to the exact details shown or described.

Having now described the features, discoveries and principles of the invention, the manner in which the improved dispenser for drywall joint compound is constructed and used, the characteristics of the construction, and the advantageous, new and useful results obtained; the new and useful structures, devices, elements, arrangements, parts and combinations, are set forth in the appended claims.

What is claimed is:

1. A container-to-tape dispenser for drywall joint compound including, in combination:

(a) a container for containing a supply of joint compound having a bottom wall and a sidewall extending upwardly therefrom, said sidewall being formed with diametrically opposed tape entrance and exit slots adjacent said bottom wall;

(b) means for supporting a roll of tape adjacent the tape entrance slot; and (c) a dispenser including:

(i) a main body having an elongated base and an inverted generally U-shaped top portion, said main body extending through the entrance and exit slots and having a longitudinally extending channel and a pair of spaced side grooves formed between the base and the top portion, said top portion having an opening formed therein for supplying compound into the channel;

(ii) a pair of vertically adjustable gates movably mounted in a pair of transverse slits formed in the top portion adjacent outer ends of said top portion and located exteriorly of the container sidewall for varying the thickness of joint compound deposited from the container onto the tape as the tape is pulled through the channel and side grooves and out of the exit slot.

2. The combination defined in claim 1 in which the container is cylindrical in shape.

3. The combination defined in claim 1 in which the means for supporting the roll of tape includes a tape holder formed by a transverse rod which is integral with and extends between a pair of spaced parallel rods, said rods having bent ends for suspending the holder from a top edge of the container sidewall above the tape entrance slot.

4. The combination defined in claim 1 in which the main body is formed of fiberglass.

5. The combination defined in claim 4 in which an upper surface of the base has a laminated plastic finish.

6. The combination defined in claim 1 in which the base is generally rectangular in shape.

7. The combination defined in claim 1 in which the inverted U-shaped top portion has a pair of identical spaced side extensions integral with and extending outwardly from said top portion along the length thereof and being parallel to and adjacent the base, each of said extensions terminating adjacent a longitudinal edge of said base.

8. The combination defined in claim 7 in which each side extension has an inverted internal stepped configuration whereby the side grooves are formed between the base and said side extensions.

9. The combination defined in claim 7 in which the top portion is attached to the base by a plurality of fasteners extending through the side extensions and said base.

10. The combination defined in claim 1 in which the opening formed in the top portion is oval-shaped and extends a substantial distance longitudinally and transversely toward the ends and sides thereof, respectively.

11. The combination defined in claim 1 in which the gate means include a gate having a transverse width greater than the width of the transverse slit and abuts the side extensions of the top portion to form a generally rectangular opening between the base and a bottom edge of the gate to meter a predetermined amount of the joint compound on the tape as said tape is pulled through the exit slot.

12. The combination defined in claim 1 in which a tape threader is adapted to be slidably mounted in the channel and side grooves for inserting the tape through the dispenser, said threader having an elongated, generally rectangular base with a length greater than that of the base of the main body and a width generally equal to the tape; and in which said threader has a vertical flange at one end thereof for manual manipulation of the threader.

13. The combination defined in claim 12 in which an outwardly facing U-shaped notch is formed in each longitudinal edge of the base of the threader to remove joint compound from the side grooves of the dispenser.

14. A dispenser adapted to be mounted in a container having a supply of a substance for depositing a layer of said substance on an elongated strip of material as said strip is pulled through the dispenser, said dispenser including:

(a) a main body having an elongated base and a top portion, forming a longitudinally extending channel and a pair of spaced side grooves between the base and the top portion, said top portion having an opening formed therein for supplying substance into the channel; and (b) vertically adjustable gate means movably mounted in the top portion of the main body adjacent an outer end thereof for varying the thickness of substance deposited from the container onto the strip of material as the said strip is pulled through the channel and side grooves and out of the dispenser.

15. The combination defined in claim 14 in which the top portion has a pair of identical spaced side extensions integral with and extending transversely from said top portion along generally its entire length and being parallel to and adjacent the base, each of said extensions terminating adjacent a longitudinal edge of said base.

16. The combination defined in claim 15 in which each side extension has an inverted stepped configuration whereby the side grooves are formed between the base and said side extension.

17. The combination defined in claim 14 in which the gate means includes a pair of gates movably mounted in a pair of transverse slits formed in the main body; in which at least one of said gates has a transverse width greater than the width of its transverse slit, said one gate abutting the side extensions of the top portion to form a generally rectangular opening between the base and a bottom edge of said one gate to meter a predetermined amount of the substance on the strip material as said strip is pulled through the exit slot.

* * * * *